US005101916A

United States Patent [19]

Lesh

[11] Patent Number: 5,101,916

[45] Date of Patent: Apr. 7, 1992

[54] WATER DRILL

[75] Inventor: Charles E. Lesh, Daytona Beach, Fla.

[73] Assignee: Acme Pumps & Well Points, Inc., Plant City, Fla.

[21] Appl. No.: 677,116

[22] Filed: Mar. 29, 1991

[51] Int. Cl.[5] ..... E21B 4/02

[52] U.S. Cl. ..... 175/107; 415/48

[58] Field of Search ..... 175/107, 393; 415/48; 418/903

[56] References Cited

U.S. PATENT DOCUMENTS 3,807,512 4/1974 Pogonowski et al. ..... 175/107 X
4,011,917 3/1977 Tiraspolsky et al. ..... 175/107
4,256,189 3/1981 Fox et al. ..... 175/107 X

*Primary Examiner*—Thuy M. Bui
*Attorney, Agent, or Firm*—Pettis & McDonald

[57] ABSTRACT

A down-whole fluid drill assembly for boring holes in the earth, having a bit attached to a housing that is rotated by the passage of a fluid through the assembly. The drill assembly comprises at least two helical vanes connected to the first portion of a shaft that is mounted within a first hollow cylindrical housing. The helical vanes are attached to the first housing, defining at least two fluid channels between the adjacent vanes, housing, and the shaft. The drill bit is attached to the first end of the first housing. The second portion of the shaft is rotatably mounted within a second hollow cylindrical housing such that the first end of the second housing is adjacent to the second end of the first housing. The second housing has a fluid passage aligned in fluid flow communication with the fluid channels. A pressurized fluid is passed through a fluid supply conduit, and then through the fluid passage and the fluid channels, causing the first housing and attached bit to rotate, drilling a hole into the earth.

12 Claims, 5 Drawing Sheets

WATER DRILL

BACKGROUND OF THE INVENTION

1. Field of the Invention

The present invention relates to a down-hole fluid drill assembly for boring holes in the earth. The drill assembly comprises a bit and housing that is rotated by the passage of a fluid through the assembly.

2. Description of the Prior Art

The two most widely used apparatuses for drilling bore holes in the earth are the surface mounted rotary drill and the down hole motor assembly. The rotary drilling method utilizes a string of drilling pipes that has a drill bit attached to the down hole free end. The drill string is rotated by a drive mechanism at the earth's surface, causing the drill bit to rotate. The down-hole assemblies utilize a motor that is attached proximal to the bit and rotates the bit by an electrical or hydraulic motor.

Down-hole hydraulic screw motors are well known in the art. One such device is disclosed in U.S. Pat. No. 469,840, issued to A. McDougall, which discloses a worm screw mounted to a shaft with a bit attached. The worm screw is rotated within a stationary casing by a hydraulic fluid flowing under pressure against the worm screw. This invention requires a continuous rigid pipe casing to be inserted within the bore hole.

U.S. Pat. No. 3,047,079, issued to G. D. Wepsala, Jr., discloses a floating shaft turbo drill that comprises a shaft having helical vanes attached about a portion of the shaft's length and a drill bit attached to one end. The shaft and vanes are mounted within a stationary casing. The stationary casing is attached to a hollow drill string that permits a hydraulic fluid to pass down the drill string to strike the vanes. The fluid impinging the vanes generates rotational forces in the shaft causing the bit to turn.

U.S. Pat. No. 4,646,856, issued to N. V. Dismukes and U.S. Pat. No. 4,823,889, issued to D. F. Baldenko, both disclose a shaft with a drill bit attached that is rotated within a stationary casing. The shafts are rotated by hydraulic fluid interacting with a rotor and stator assembly. Both inventions are attached to the standard rigid drill string.

U.S. Pat. No. 1,482,702, issued to C. C. Scharpenberg, discloses a turbine motor that comprises a rotatable central shaft, having a series of spaced apart power vanes attached along the length of the shaft and a drill bit attached to one end of the shaft. The shaft and vanes are mounted within a stationary shell that has a series of vertically spaced apart sets of stationary guide vanes that alternate with the power vanes. The shell is attached to a drill string permitting hydraulic fluid to pass down the drill string impinging the power vanes causing the vanes, shaft and drill bit to rotate.

U.S. Pat. No. 4,253,532, issued to B. Geczy, discloses a rotatable helicoidal rotor mounted within a cavity stator to create a positive rotation of a shaft to which a drill bit is attached. During normal operation, the stator is stationary; however, the exterior casing of the drill motor may be rotated by rotational equipment at the earth's surface when a clutch is engaged.

U.S. Pat. No. 4,406,332, issued to N. V. Dismukes, discloses a drill bit mounted to a shaft that is rotated by attached turbine blades mounted within a non-rotating flexible drill pipe. Also attached to the shaft is a propeller blade that has jet nozzles located near the propeller tips to provide additional rotative torque.

None of the prior art discloses helical vanes connected both to a shaft and to the exterior housing to which the drill bit is attached. In addition, all the prior art that is used for drilling vertical shafts into the ground disclose rigid pipe strings. The present invention utilizes a flexible hose which is much lighter than the pipe strings allowing a single person to operate the fluid drill assembly. The rotation of the housing and bit combination provides increased moment force to assist in overcoming obstacles to the drilling. In addition, the spiraling motion of the housing will help seal the walls of the bore hole to reduce the probability of cave in.

SUMMARY OF THE INVENTION

The present invention relates to a down-hole fluid drill assembly for boring holes in the earth, comprising a housing with a bit attached that is rotated by the passage of fluid through the assembly. The drill assembly is constructed so that one or two persons are capable of operating the drill without a derrick or an A-frame type support. Most simply stated, the fluid drill assembly is comprised of a rotatable shaft with connected helical vanes that are mounted within and attached to a first housing. A drill bit is attached to one end of the first housing while the second end is rotatably attached to a second housing. The second housing is connected to a fluid supply means which transfers fluid under pressure to the drill assembly from a fluid pressure means on the earth's surface.

The shaft has a first portion which includes a first end and a second portion which includes a second end. The shaft is rotatable about its longitudinal axis. To this shaft is connected at least two helical vanes, each of which have an axis that generally coincides with the axis of the shaft. Each vane has an inward edge and an outward edge; the inward edge being connected to the first portion of the shaft such that the vanes are spaced apart and generally parallel to one another. The first portion of the shaft, with the vanes attached, is inserted within a first hollow cylindrical housing that has an axis, a first end and a second end. The housing is attached to the outward edge of the vanes defining at least two fluid channels between the adjacent vanes, the first housing and the shaft. A drill bit is attached to the first end of the first housing.

The second portion of the shaft is inserted within a second hollow cylindrical housing. The second housing is rotatably mounted to the second portion of the shaft so that the first end of the second housing is adjacent to the second end of the first housing. The second housing is mounted to the shaft by a mounting means that provides at least one axial fluid passage that is aligned in fluid flow communication with the fluid channels of the first housing. A fluid supply means is connected to the second end of the second housing in fluid flow communication with the fluid passage means. The second end of the fluid supply means is operatively connected to a fluid pressure means that forces the fluid under pressure through the supply means, the fluid passage means, and into the fluid channels of the first housing where the fluid pushes against the vanes causing the vanes to rotate. The axial rotation of the vanes causes the attached first housing and connected drill bit to rotate.

When the fluid drill assembly is placed in a bore hole, the weight of the assembly and the length of the rigid portion of the assembly causes the drill assembly to bore straight vertical holes in the earth. If resistance to the rotation of the drill bit occurs, the drill assembly may be raised from the bottom of the hole to permit the first housing and the cutting bit to begin rotating again. The rotating peripheral mass of the housing provides additional torque to the cutting bit to overcome obstacles in the bore hole. In addition, the spiraling motion of the first housing assists in the sealing of the walls to reduce the possibility of cave-ins. The fluid exiting the fluid channels passes by the cutting bit helping to lubricate and cool it. The fluid then exits the bore hole through the entry point of the bore hole in the earth carrying with the fluid the material that has been loosened by the drill bit.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
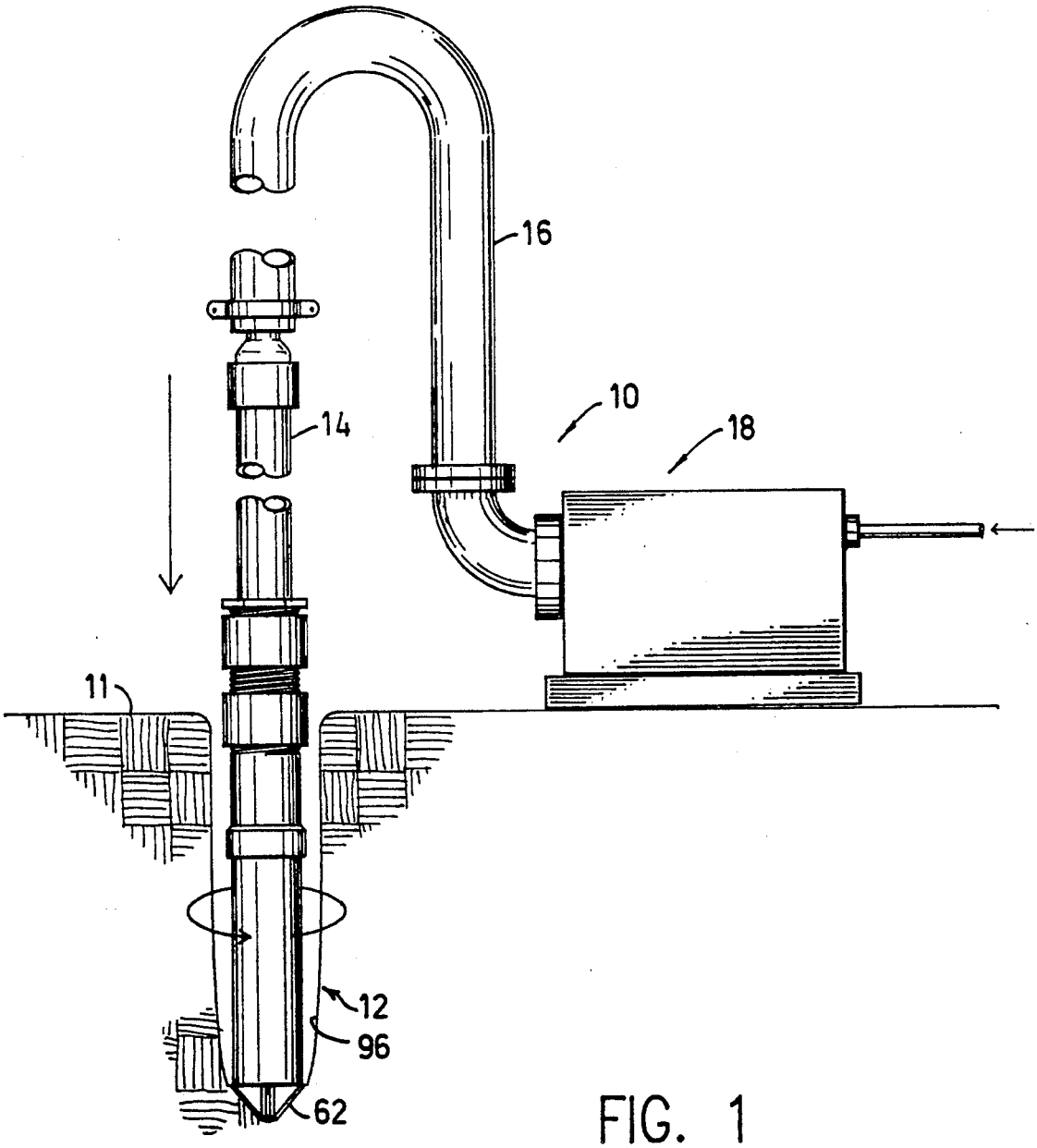
FIG. 1 is an elevation of the preferred embodiment of the fluid drill assembly illustrating its relationship with the earth's surface.

A preferred embodiment for the fluid drill assembly is disclosed in FIGS. 1-7, with the fluid drill assembly shown generally as 10. The fluid drill assembly 10, illustrated in FIG. 1, is comprised of the fluid drill, shown generally as 12, tail piece 14, fluid supply hose 16 and a fluid pressure means shown generally as 18.

Figure 2:
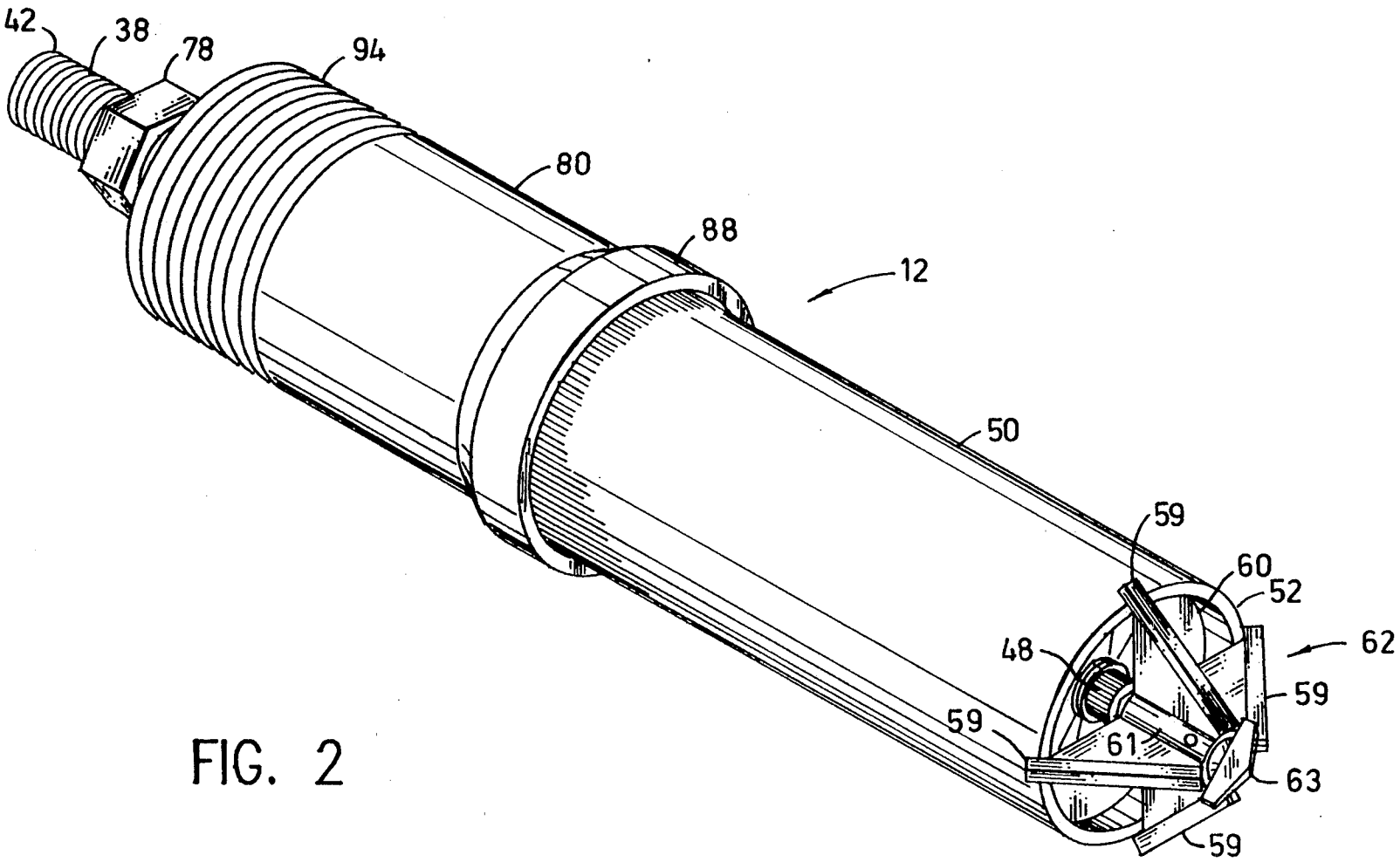
FIG. 2 is a perspective view of the preferred embodiment of the fluid drill.
Figure 3:
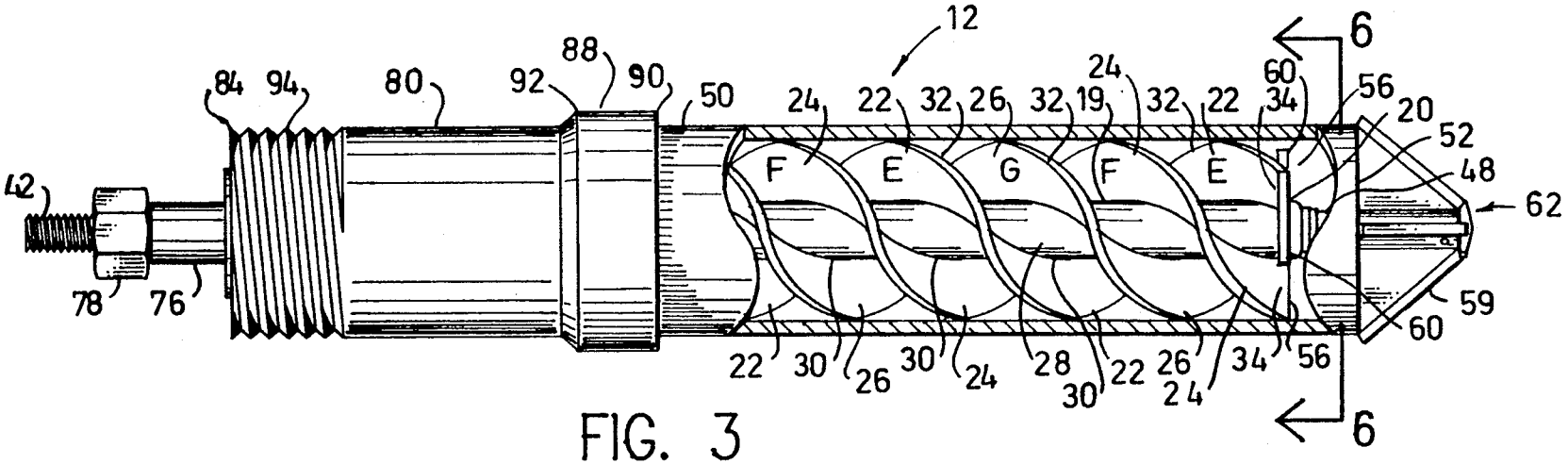
FIG. 3 is a side elevation view of the preferred embodiment with a portion of the first housing broken away disclosing its internal parts.
Figure 4:
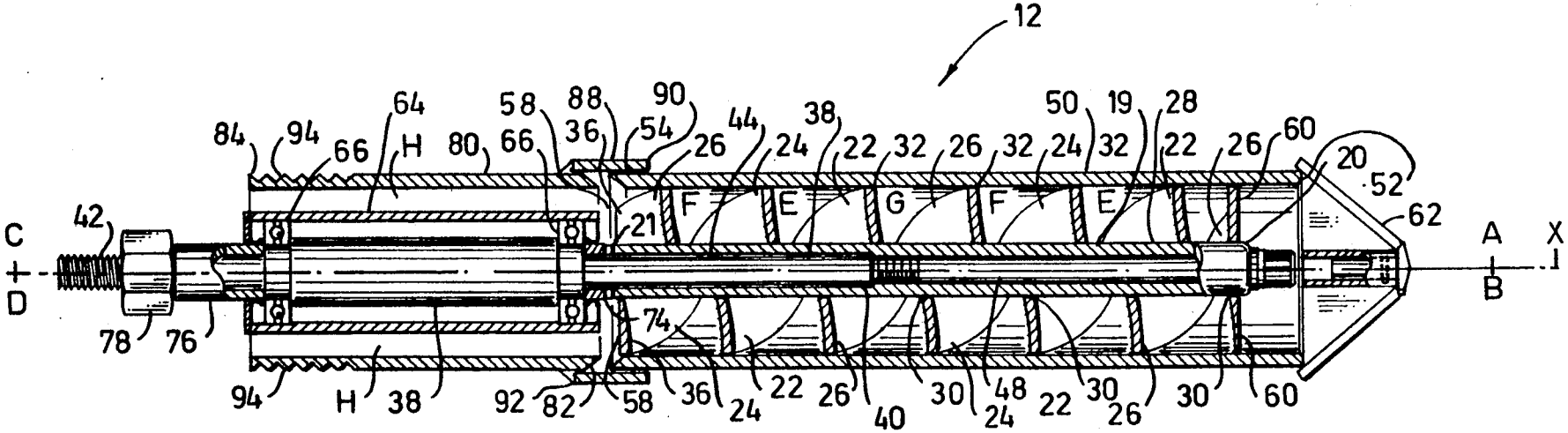
FIG. 4 is a partial cross sectional view of the first and second housings and their internal parts, similar to the view of FIG. 3.

The preferred embodiment of the fluid drill 12, as shown in FIG. 2, and more clearly in FIGS. 3 and 4, comprises a hollow first interior cylinder 19 that has a first end 20, a second end 21, and a longitudinal Axis A. Attached to the exterior surface 28 of the first interior cylinder 19 are three helical vanes 22, 24, and 26. Each helical vane 22, 24 and 26 has an inward edge 30 and an outward edge 32, the inward edge 30 being attached to the exterior surface 28 of the first interior cylinder 19. In the preferred embodiment, the vanes 22, 24, and 26 are spaced apart and substantially equidistant from one another and generally parallel to one another. However, in other embodiments, the fluid drill may be configured without the vanes being equidistant or parallel to one another. Each vane has a first end 34 and a second end 36, with the first end 34 of each vane 22, 24 and 26 (the first end 34 of vane 26 is not shown) defining a plane generally perpendicular to the axis B of the vanes 22, 24 and 26 and the axis A of the first interior cylinder 19. The first end 34 of each vane is proximal to the first end 20 of the interior cylinder 19. In a similar fashion, the second ends 36 of each vane 22 (the second end 36 of vane 22 is not shown), 24, and 26 define a plane generally perpendicular to the axis A of the first interior cylinder 19 and the axis B of the vanes 22, 24, and 26. The second ends 36 of the vanes 22, 24 and 26 are proximal to the second end 21 of the first interior cylinder 19.

As seen in FIG. 4, an axially rotatable shaft 38, having an axis C, a first end 40, and a second end 42, also has a first portion 44 that includes the first end 40 and a second portion 46 which includes the second end 42. The first portion 44 of the shaft 38 is sized and configured to be received by the first interior cylinder 19 and is attached to the interior cylinder 19 by an attaching means, bolt 48.

Figure 6:
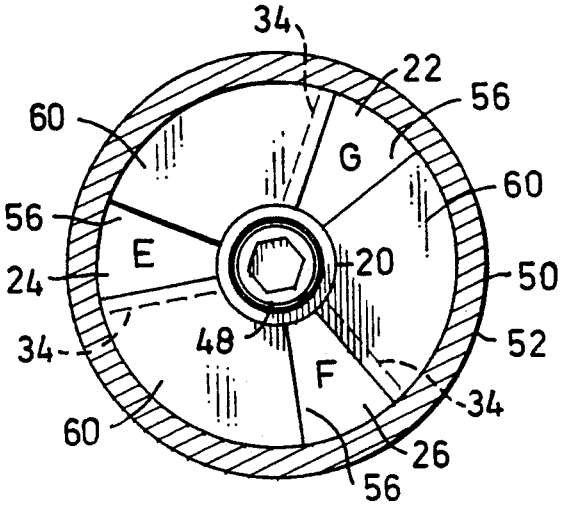
FIG. 6 is a cross sectional view of the preferred embodiment taken along lines 6—6 of FIG. 3.

A first hollow cylindrical housing 50, having a first end 52, a second end 54, and an axis D, is sized and configured to receive the first portion 44 of the shaft 38, with the first interior cylinder 19 attached and the vanes 22, 24 and 26 attached thereon. The first housing 50 is attached to the outward edge 32 of the vanes 22, 24, and 26. Three fluid channels, E, F, and G, each having a first end 56 (not shown for channel F) and a second end 58 (not shown for channel E), are defined by the first interior cylinder 19, the first housing 50 and each pair of adjacent vanes 22, 24, and 26. As best seen in FIG. 6, a restricting means comprising plates 60 is attached to each first end 34 of each vane 22, 24 and 26 to reduce the open cross section of the first end 56 of each channel E, F and G. Each plate 60 is attached at substantially right angles to the axis B of the helical vanes, 22, 24 and 26 and is also attached to the adjacent first interior cylinder 19 and the first housing 50. A drill bit 62 is attached to the first end 52 of the first housing 50.

Figure 7:
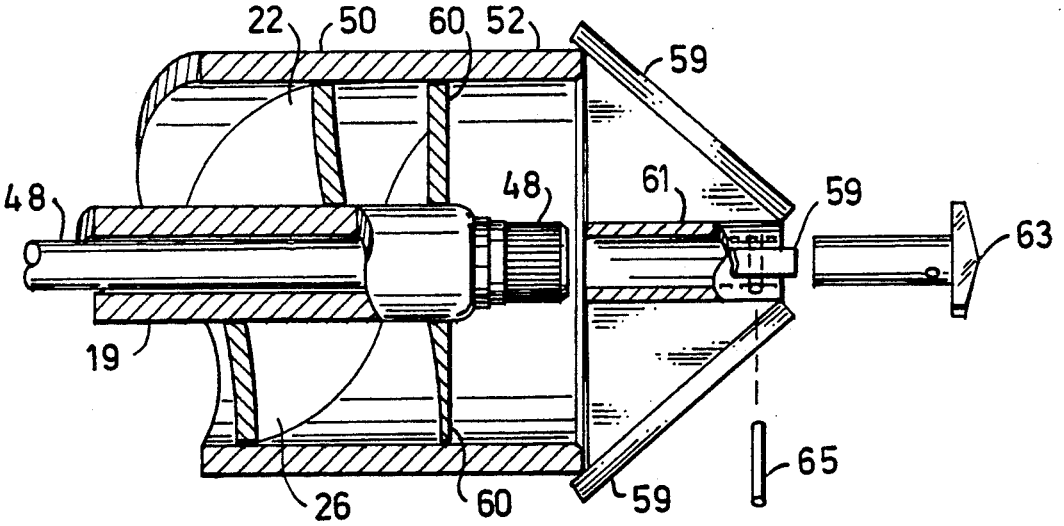
FIG. 7 is a detailed exploded view of the drill bit of the preferred embodiment with portions of the first housing and its internal parts in cross-section.

An exploded view of the preferred embodiment of the drill bit 62 is illustrated in FIG. 7. The drill bit comprises four cutting bars 59 attached to the first end 52 of the first housing 50 and a hollow core 61. The core 61 is hollow in order to gain easy access to bolt 48. A center cutter 63 is removably inserted into the core 61 and attached by a pin 65. While this is the preferred embodiment, other conventional drill bits may be adapted for use with this invention.

Figure 5:
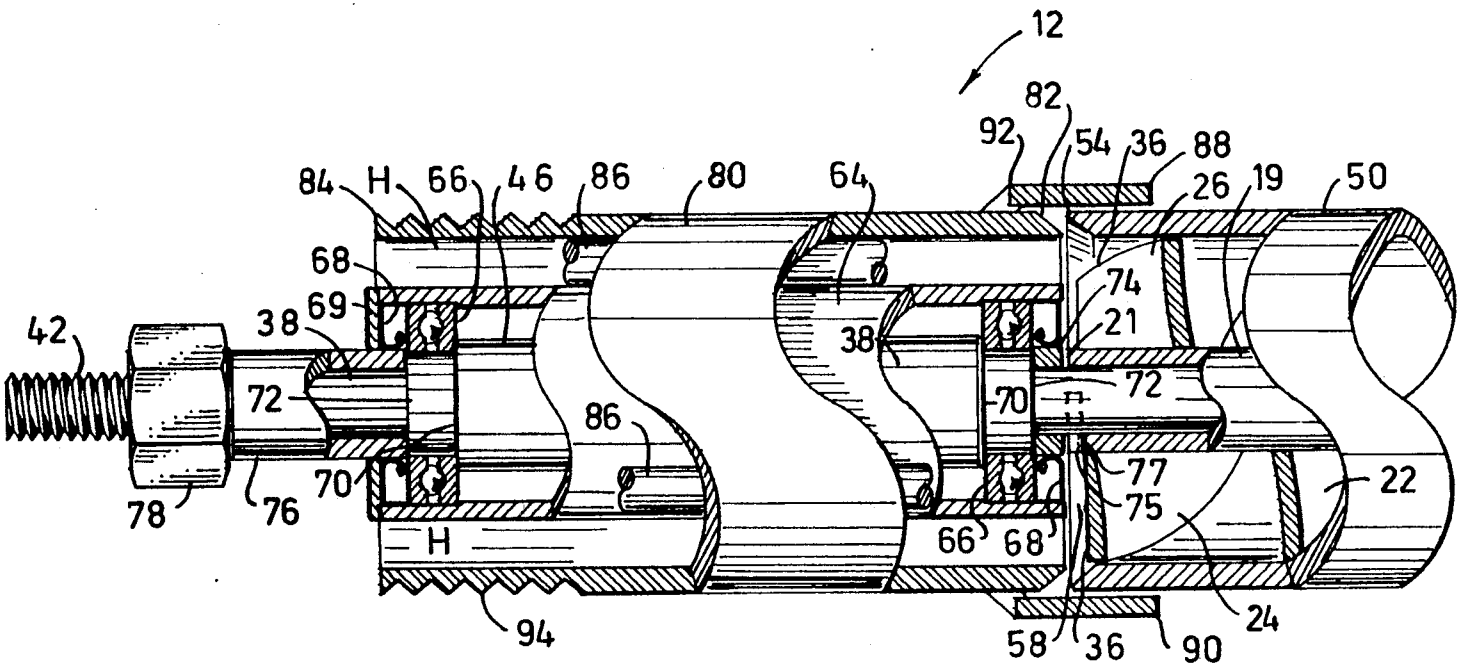
FIG. 5 is a detailed view of a portion of the side elevation of the preferred embodiment with portions of the housings broken away and portions of the parts shown in cross-section.

A mounting means rotatably attaches the second portion of the shaft 38 to a hollow cylindrical second housing 80. As shown in FIG. 5, the mounting means comprises a second interior cylinder 64, two bearing means 66, two sealing means 68 and three spacing means 86.

As shown in FIG. 5, the hollow second interior cylinder 64 is mounted on and spaced apart from the second portion 46 of the shaft 38 by the pair of bearing means 66 and the pair of sealing means 68. In the preferred embodiment, the pair of bearing means 66 are illustrated as ball bearings; however, at least one of any well known bearing that is suitable for the purpose may be used. The diameter of the shaft 38 inward of each of the annular bearings 66 is greater than the diameter of the shaft 38 where the shaft 38 passes through the bearings 66, creating a pair of shoulders 70 against which the bearings 66 rest. A second pair of annular shoulders 72 are formed on the shaft 38 so that a first spacer 74 and a second spacer 76 may be mounted on the shaft 38 adjacent to a respective bearing 66. Spacer 74 is mounted radially interior to the annular sealing rings 68 so that the first interior cylinder 19 may be kept spaced apart from the second interior cylinder 64. In addition, a pin 75 is inserted into the shaft 38 to engage a notch 77 in the second end 21 of the first interior cylinder 19 which rotatingly locks the first cylinder 19 to the shaft 38, so that as the first cylinder 19 rotates, the shaft will likewise rotate. The second spacer 76 is mounted on the shaft 38 between the nut 78 and the second shoulder 72 to hold the adjacent bearing 66 in place against the first shoulder 70 while keeping the nut 78 spaced apart from the seal 68. A splash protector 69, having the configuration of a standard washer, is mounted over the second spacer 76 and located adjacent the sealing means 68 and the second interior cylinder 64. The splash protector 69 reduces the fluid pressure that is directly applied against the sealing means 68 reducing leakage between the sealing means 68 and the second interior cylinder 64 and the shaft 38. The shaft 38 is now rotatably mounted within and spaced apart from the second interior cylinder 64.

The hollow cylindrical second housing 80, having an axis X, a first end 82, and a second end 84, generally has the same cross sectional configuration and circumference as the first housing 50. The second housing 80 is mounted on the second interior cylinder 64 such that the first end 82 of the second housing 80 is adjacent to the second end 54 of the first housing 50. The axis X generally coincides with axes A, B, C and D. In the preferred embodiment, the three spacing means 86, spaced generally equidistant from one another, are attached to the second interior cylinder 64 and the second housing 80 so that the second housing 80 is spaced apart from the second interior cylinder 64. The spacing means 86 is configured to define a fluid passage H between the second interior cylinder 64 and the second housing 80. This fluid passage H is aligned in fluid flow communication with fluid channels E, F and G. In the preferred embodiment, three spacing means 86 are formed from round stock; however, any reasonable configuration which permits generally undisturbed water flow through fluid passage H may be used.

The second end 92 of a sleeve 88 is attached to the second housing 80 leaving its first end 90 free. The sleeve 88 is so configured that the second end 54 of the first housing 50 is inserted within the sleeve 88.

The tail piece 14 in the preferred embodiment is a portion of rigid pipe that is threadably attached to the threads 94 of the second housing 80. The other end of the tail piece 14 is attached by any conventional means to the fluid supply hose 16, which is attached to a fluid pressure means 18 that may be any conventional pump suitable for this purpose.

In the preferred embodiment, the drill bit 62 is constructed of carbide steel and the fluid drill 12 and tail piece 14 are comprised primarily of steel, but may be formed from any suitable materials well known in the trade. The fluid supply hose 16 is made from any flexible material well known in the art for flexible hoses.

Having thus set forth a preferred construction for the fluid drill assembly 10, it is to be remembered that this is but a preferred embodiment. Attention is now invited to a description of the use of the fluid drill assembly 10. The fluid drill assembly 10 is assembled generally as shown in FIG. 1 with the fluid drill 12 in vertical relationship with the earth's surface 11. In the preferred embodiment, water is used to operate the fluid drill 12; however, an air water combination, air alone or another fluid suitable for the purpose may be used. The fluid is pumped under pressure by a fluid pressure means 18 through the fluid supply hose 16 and the tail piece 14 to the second end 84 of the second housing 80 where the fluid enters and passes through the fluid passage H. The fluid then enters the fluid channels E, F and G, pushing upon vanes 22, 24 and 26 causing the vanes to rotate. Rotation of the vanes 22, 24 and 26 rotates the shaft 28, the first interior cylinder 19, the first housing 50 and the attached drill bit 62. The second housing 80 and the second interior cylinder remain stationary. The weight of the fluid drill assembly 10 applies downward pressure on the drill bit 62, causing it to bite into the earth as it rotates. Additionally, the downward force of the water on the vanes 22, 24, and 26 applies a vertical load upon the drill bit 62. The fluid leaves the first end of the fluid channels E, F and G, passes through the drill bit 62, flushing and cooling it, and then moves upward along the sides of the bore hole 96 and out the top of the hole. The movement of the water flushes much of the material that has been cut by the drill bit 62 from the bore hole 96. The rotary motion of the first housing 50 coats the wall of the bore hole 96 with material cut from the bottom of the hole. When that material is clay or similar material, it helps to stabilize the wall of the bore hole 96. The length of the drill assembly 10 that is rigid helps the drill assembly 10 maintain a straight bore hole 96.

If an obstacle is encountered in the bottom of the bore hole 96, which causes the first housing 50 to stop rotating, the operator will simply raise the fluid drill 12 so that the first housing 50 and drill bit 62 will begin rotating again. Because the housing 50 rotates with the drill bit 62, the moment force that is applied to the drill bit 62 is increased by the mass of the housing 50, enabling the drill bit 62 to work through obstacles in its path.

It will thus be seen that the objects set forth above, among those made apparent from the preceding description, are efficiently attained and, since certain changes may be made in the above article without departing from the scope of the invention, it is intended that all matter contained in the above description, or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A down-hole fluid drill assembly for boring holes in the earth, operable by a fluid passing therethrough, said assembly comprising:

an axially rotatable shaft having a first end and a second end, a first portion including said first end and a second portion including said second end;

at least two helical vanes each having an axis and said axes being generally coincident, said vanes having an inward edge and an outward edge, said inward edge of each of said vanes being connected to said first portion of said shaft such that said vanes are generally parallel to one another;

a first hollow cylindrical housing having an axis, a first end, and a second end, said first portion of said shaft being inserted within said first housing such that said axis of said shaft generally coincides with said axis of said first housing, and said first housing being attached to said outward edges of said vanes thereby defining at least two fluid channels between said adjacent vanes, said first housing, and said shaft;

a drill bit attached to said first end of said first housing;

a hollow cylindrical second housing having an axis, a first end, and a second end, said second portion of said shaft being inserted within said second housing such that said axis of said shaft generally coincides with said axis of said second housing; a mounting means rotatably attaching said second portion of said shaft to said second housing such that said first end of said second housing is adjacent to said second end of said first housing, said second housing having a fluid passage means aligned in fluid flow communication with said fluid channels;

a fluid supply means having a first end and a second end, said first end being connected to said second end of said second housing in fluid flow communication with said fluid passage means; and a fluid pressure means operatively connected to said second end of said fluid supply means, whereby said fluid is passed through said fluid passage and said fluid channels under pressure whereby said fluid causes said vanes to rotate and thus rotate said first housing and said attached drill bit.

2. A fluid drill assembly as in claim 1 wherein each said vane is substantially equidistant from each adjacent vane.

3. A fluid drill assembly as in claim 1 wherein each said vane further comprises a first end, said first end of each said vane having a radial edge and said radial edges defining a plane generally perpendicular to the axes of said vanes.

4. A fluid drill assembly as in claim 1 wherein each said vane further comprises a first end, and each said channel further comprises a first and a second open end, a restricting means attached to said first end of each said vane such that the cross-section of each said first open end of each said channel is reduced.

5. A fluid drill assembly as in claim 1 further comprising a hollow first interior cylinder interposed between said first housing and said shaft, said inward edges of said vanes being attached to said first interior cylinder, said first portion of said shaft being sized and configured to be received by said first interior cylinder, and an attaching means to attach said first interior cylinder to said shaft.

6. A fluid drill assembly as in claim 1 wherein said mounting means comprises a hollow second interior cylinder interposed between and spaced apart from said shaft by at least one bearing means, such that said shaft is rotatably received within said bearing means, and at least one spacing means interposed between and attached to both said second housing and said second interior cylinder thereby spacing apart said second interior cylinder from said second housing and defining said fluid passage means therebetween.

7. A fluid drill assembly as in claim 6 wherein said mounting means further comprises at least one sealing means interposed between said second portion of said shaft and said second interior cylinder, whereby said shaft is sealingly rotatable within said second interior cylinder.

8. A fluid drill assembly as in claim 1 wherein said second housing has a cross-sectional configuration and circumference generally the same as that of said first housing.

9. A fluid drill assembly as in claim 1 further comprising a tail piece, said tail piece comprising a pipe section having a first end and a second end, said tail piece being interposed between said second housing and said fluid supply means with said first end of said tail piece attached in fluid flow communication with said second end of said housing and said second end of said tail piece attached in fluid flow communication with said fluid supply means.

10. A fluid drill assembly as in claim 1 wherein said fluid supply means comprises a flexible hose having a first end attached to said second end of said housing and a second end connected to said fluid pressure means.

11. A fluid drill assembly as in claim 1 further comprising a sleeve, said sleeve having a circumference greater than that of said second end of said first housing, said sleeve being attached to said first end of said second housing such that said second end of said first housing lies within said sleeve.

12. A down-hole fluid drill assembly for boring holes in the earth, operable by a fluid passing therethrough, said assembly comprising:

a hollow first interior cylinder having an exterior surface;

an axially rotatable shaft having a first end and a second end, a first portion including said first end and a second portion including said second end, said first portion of said shaft being sized and configured to be received by said first interior cylinder, and an attaching means attaching said shaft to said first interior cylinder;

at least two helical vanes each having an axis, a first end and a second end, an inward edge and an outward edge, said inward edge of each of said vanes being attached to said exterior surface of said first interior cylinder such that the axes of said vanes are generally coincident, each said vane being substantially equidistant from each adjacent vane, and said vanes being generally parallel to one another, each said vane further comprising a radial edge on each said first and said second end of each said vane, said radial edges defining a plane generally perpendicular to the axes of said vanes;

a hollow cylindrical first housing having an axis, a first end, and a second end, said first housing being sized and configured to axially receive said first interior cylinder and said vanes, said first housing being attached to said outward edges of said vanes thereby defining at least two fluid channels between said adjacent vanes, said first housing, and said shaft, each said channel having a first and a second open end, and a restricting means being attached to said first end of each of said vanes such that the cross-section of each said first open end of each said channel is reduced;

a drill bit attached to said first end of said first housing;

a hollow second interior cylinder, mounted on and spaced apart from said second portion of said shaft by at least one bearing means, and at least one sealing means interposed between said second portion of said shaft and said second interior cylinder, whereby said shaft is sealingly rotatable within said second interior cylinder;

a hollow cylindrical second housing having an axis, a first end, and a second end, said second housing having a cross-sectional configuration and circumference generally the same as that of said first housing, said second housing being axially mounted on and spaced apart from said second interior cylinder such that said first end of said second housing is adjacent to said second end of said first housing, and at least one spacing means interposed between and attached to both said second housing and said second interior cylinder thereby defining a fluid passage therebetween, said fluid passage being aligned in fluid flow communication with said fluid channels;

a sleeve, having a circumference greater than the circumference of said second end of said first housing, said sleeve being attached to said first end of said second housing such that said second end of said first housing lies within said sleeve;

a tail piece, said tail piece comprising a pipe section attached to said second end of said second housing in fluid flow communication with said fluid passage;

a fluid supply house connected in fluid flow communication with said tail piece, and a fluid pressure means operatively connected to said fluid supply hose, whereby said fluid is passed through said fluid passage and said fluid channels under pressure causing said vanes to rotate and thus rotate said first housing and said attached drill bit.

* * * * *

UNITED STATES PATENT AND TRADEMARK OFFICE

CERTIFICATE OF CORRECTION

PATENT NO. : 5,101,916

DATED : April 7, 1992

INVENTOR(S) : CHARLES E. LESH

It is certified that error appears in the above-identified patent and that said Letters Patent is hereby corrected as shown below:

In the Abstract, line 1, "A down-whole" should be --A down-hole--.

In line 8 of the ABSTRACT, the word "first" should be inserted before the word "housing,".

IN THE CLAIMS:

CLAIM 12, column 10, line 8, "house" should be --hose--.

Signed and Sealed this

Third Day of August, 1993

*Attest:*

Michael K. Kirk

MICHAEL K. KIRK

*Attesting Officer*

*Acting Commissioner of Patents and Trademarks*